US008015625B2

(12) United States Patent
Grim et al.

(10) Patent No.: US 8,015,625 B2
(45) Date of Patent: Sep. 13, 2011

(54) BICYCLE HELMET ADJUSTMENT MECHANISM

(75) Inventors: Michael Grim, Aptos, CA (US); David E Stroud, Santa Cruz, CA (US)

(73) Assignee: Specialized Bicycle Components, Morgan Hill, CA (US)

( * ) Notice: Subject to any disclaimer, the term of this patent is extended or adjusted under 35 U.S.C. 154(b) by 272 days.

(21) Appl. No.: 12/436,660

(22) Filed: May 6, 2009

(65) Prior Publication Data

US 2010/0281604 A1 Nov. 11, 2010

(51) Int. Cl.
*A42B 1/22* (2006.01)

(52) U.S. Cl. ..... 2/420; 2/418

(58) Field of Classification Search ..... 2/418, 183, 2/426, 8.1, 419, 420, 417
See application file for complete search history.

(56) References Cited

U.S. PATENT DOCUMENTS

| | | | | |
|---|---|---|---|---|
| 2,205,741 | A | 6/1940 | Bowers | |
| 2,205,742 | A | 6/1940 | Bowers | |
| 2,926,406 | A | 3/1960 | Edwards et al. | |
| 3,214,809 | A | 11/1965 | Edwards | |
| 3,325,824 | A | 6/1967 | Donegan | |
| 3,329,968 | A | 7/1967 | Gordon | |
| 3,444,560 | A * | 5/1969 | Northup, Jr. | 2/8.1 |
| 4,888,831 | A | 12/1989 | Oleson | |
| 5,357,654 | A | 10/1994 | Hsing-Chi | |
| 5,659,900 | A | 8/1997 | Arney et al. | |
| 5,887,288 | A | 3/1999 | Arney et al. | |
| 5,950,245 | A * | 9/1999 | Binduga | 2/417 |
| 6,256,798 | B1 | 7/2001 | Egolf et al. | |
| 6,314,588 | B1 | 11/2001 | Fang | |
| 6,401,261 | B1 | 6/2002 | Arney et al. | |
| 7,174,575 | B1 * | 2/2007 | Scherer | 2/418 |
| 7,222,374 | B2 | 5/2007 | Musal et al. | |
| 7,854,024 | B2 * | 12/2010 | Fang | 2/418 |
| 2006/0048285 | A1 | 3/2006 | Bielefeld et al. | |
| 2006/0225187 | A1 | 10/2006 | Wu | |
| 2007/0157372 | A1 | 7/2007 | Musal et al. | |
| 2007/0266481 | A1 | 11/2007 | Alexander et al. | |
| 2008/0295229 | A1 | 12/2008 | Fang | |

FOREIGN PATENT DOCUMENTS

| | | |
|---|---|---|
| WO | 2007025500 | 3/2007 |

* cited by examiner

*Primary Examiner* — Danny Worrell
(74) *Attorney, Agent, or Firm* — Michael Best & Friedrich LLP

(57) ABSTRACT

A helmet adjustment mechanism is adapted to adjust the size of a helmet having first and second retention members (e.g., plastic straps) movable with respect to each other. The adjustment mechanism includes an actuating member (e.g., a pinion) coupled to at least one of the retention members and movable (e.g., rotatable) in two directions to move at least one of the retention members relative to the other. A clutch mechanism is coupled to the actuating member and includes at least one locking member (e.g., two locking members) that inhibits movement of the actuating member in both of the two directions. The adjustment mechanism also includes a release mechanism (e.g., including a rotary dial) adapted to move the locking member from a locked position to an unlocked position to allow movement of the actuating member. When the actuating member is being moved, the adjustment mechanism also provides a ratcheting detent.

19 Claims, 6 Drawing Sheets

BICYCLE HELMET ADJUSTMENT MECHANISM

BACKGROUND

The present invention generally relates to the field of bicycle helmets, and specifically to mechanisms for adjusting the size of bicycle helmets.

Bicycle helmets have progressed to be highly-engineered pieces of equipment. One important aspect of a bicycle helmet design is that it fit comfortably and securely on a user's head. One way of making a helmet comfortable and secure is to provide an adjustable harness that is secured inside the helmet shell and wraps around a user's head.

SUMMARY

The present invention provides a helmet adjustment mechanism that is adapted to adjust the relative position of two parts of the helmet. The adjustment mechanism is particularly suited for bicycle helmets having a shell adapted to fit on a user's head, and first and second retention members (e.g., plastic straps having toothed slots) coupled to the shell and movable with respect to each other to adjust a size of the helmet. The adjustment mechanism is coupled to the retention members and includes an actuating member (e.g., a pinion) coupled to at least one of the retention members and movable (e.g., rotatable) in two directions to move at least one of the retention members relative to the other. The adjustment mechanism further includes a clutch mechanism coupled to the actuating member and including at least one locking member (e.g., two locking members) that inhibits movement of the actuating member in both of the two directions. The locking member is movable between a locked position, where the actuating member is substantially prevented from moving, and an unlocked position, where the actuating member is not substantially prevented from moving. The adjustment mechanism also includes a release mechanism (e.g., including a rotary dial) adapted to move the locking member from the locked position to the unlocked position to allow movement of the actuating member. When the actuating member is being moved, the adjustment mechanism also provides a ratcheting detent.

In one embodiment, the clutch mechanism includes a first locking member that inhibits movement of the actuating member in a first direction (e.g., counter-clockwise) and a second locking member that inhibits movement of the actuating member in a second direction (e.g., clockwise). Each of the first and second locking members is preferably movable between a locked position, where the actuating member is substantially prevented from moving in the respective direction, and an unlocked position, where the actuating member is not substantially prevented from moving in the respective direction. In this embodiment, the release mechanism is adapted to move the first locking member from the locked position to the unlocked position while simultaneously leaving the second locking member in the locked position to thereby allow the actuating member to move in the first direction. When the actuating member is being moved in the first direction, the second locking member can provide the ratcheting detent, but still retains its locking feature to prevent movement in the second direction.

In order to provide the locking feature, the clutch mechanism can include a series of clutch teeth for releasable engagement by the locking members. Preferably, the locking members each include a flexible arm having a latch portion (e.g., a latch tooth) for engaging the clutch teeth, and a first cam portion. In this embodiment, the adjustment mechanism can further include an input member (e.g., a rotary dial) movable by a user and including a second cam portion adapted to engage the first cam portion to move the locking member from the locked position to the unlocked position.

In one embodiment, the input member is movable relative to the clutch member between a static position and an adjusting position. In this embodiment, the locking member is in the locked position when the input member is in the static position, and movement of the input member to the adjusting position automatically moves the locking member to the unlocked position. Preferably, the input member further includes a drive portion adapted to drive the actuating member (e.g., tabs on the clutch member) when the input member is in the adjusting position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
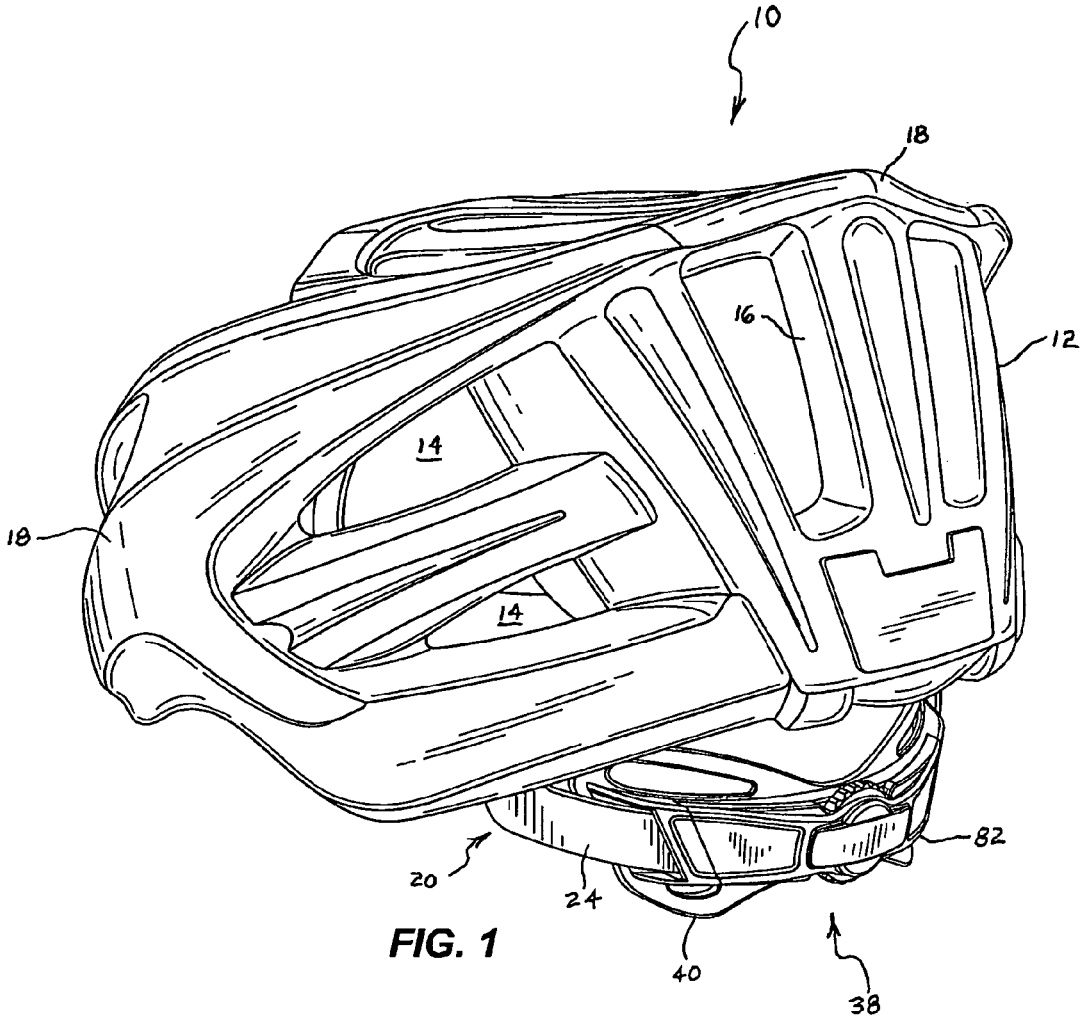
FIG. 1 is a perspective view of a bicycle helmet having an adjustment mechanism embodying features of the present invention.

The helmet 10 in FIG. 1 includes a shell 12 that provides protection to the user's head. The shell 12 includes a concave interior dimensioned to fit over a user's head, and a series of openings 14 to provide ventilation to the user. The shell 12 can be made from any suitable protective material, such as an impact-absorbing layer 16 made from closed cell polystyrene foam adhered to a molded outer skin 18 made from polycarbonate plastic.

The helmet 10 further comprises a retention mechanism in the form of a harness 20 including several stabilizers (not shown) secured to the shell 12 (e.g., molded into the shell 12 or attached by mechanical, adhesive, or other means), as is known in the art. The harness 20 further includes a strap portion 24 designed to encompass a user's head. The strap portion 24 includes two ends that define first and second straps 26,28 that facilitate adjusting the size of the strap portion to accommodate different-sized heads. The harness 20 can be made from any suitable material, such as plastic, wire, woven fabric, and the like.

Figure 2:
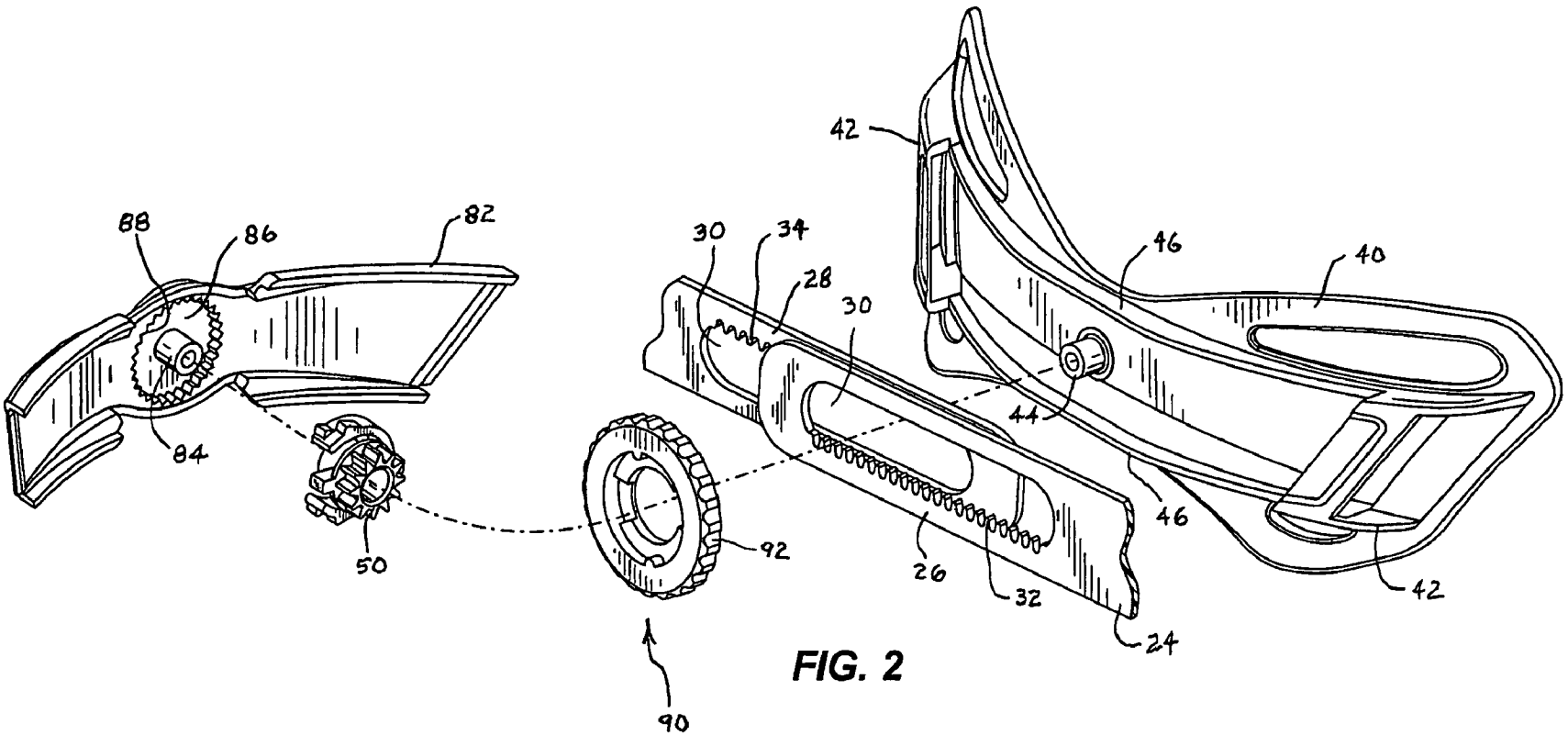
FIG. 2 is an exploded perspective view of the adjustment mechanism of FIG. 1.

Referring to FIG. 2, each strap 26,28 includes an opening in the form of a slot 30. The first strap 26 includes lower teeth 32 defining a lower perimeter of the corresponding slot 30, and the second strap 28 includes upper teeth 34 defining an upper perimeter of the corresponding slot 30. The two straps 26,28 overlap each other such that the slot 30 of the first strap 26 at least partially overlaps the slot 30 of the second strap 28. In an alternative embodiment (not shown), instead of have a slot with teeth, the strap could instead be a very thin, elongated member with teeth along one side of the strap, similar to a toothed rack.

The helmet 10 further includes an adjustment mechanism 38 for adjusting the straps 26,28 to fit the user's head size. The adjustment mechanism 38 includes a base member 40 designed to cover the occipital region of the user's head. The base member 40 is butterfly-shaped, and includes opposing bridge portions 42 through which the straps 26,28 are threaded. A base post 44 is positioned in a center region of the base member 40 such that it is positioned in the slots 30 of the straps 26,28 when the straps 26,28 are threaded through the bridge portions 42. Alignment walls 46 extend from the central region of the base member 40 on opposing sides of the base post 44 and are positioned to maintain the straps 26,28 in an overlapping relationship.

Figure 3:
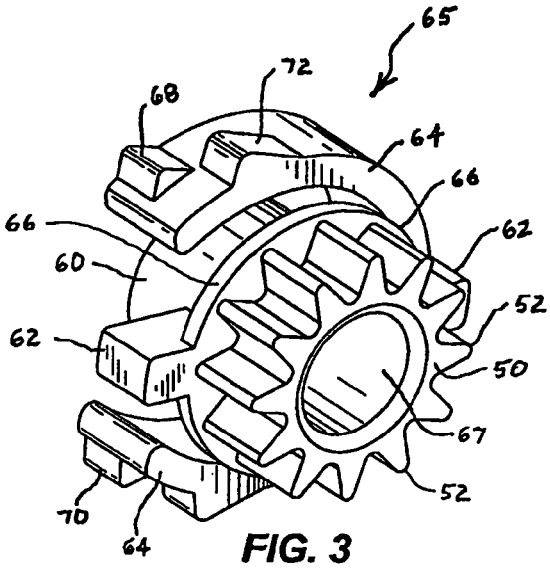
FIG. 3 is a front perspective view of a clutch member.
Figure 4:
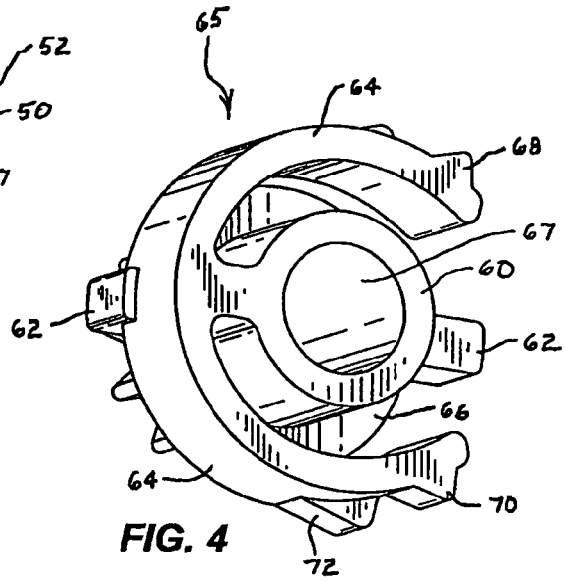
FIG. 4 is a rear perspective view of the clutch member.
Figure 6:
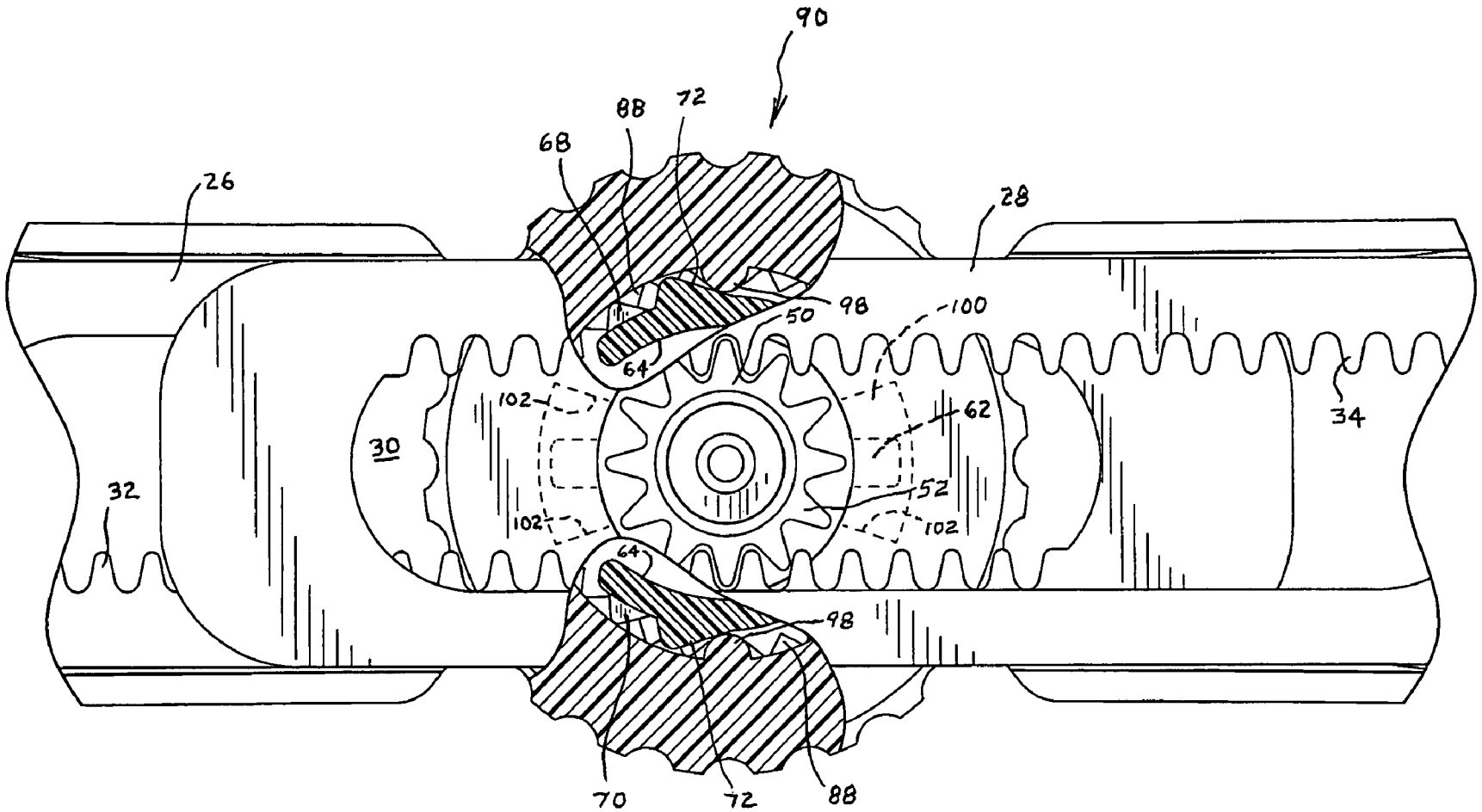
FIG. 6 is a front view of the adjustment mechanism in partial section with the adjustment mechanism in a neutral position.

The adjustment mechanism 38 further includes an actuating member in the form of a pinion 50 rotationally mounted on the base post 44. Referring to FIGS. 3, 4 and 6, the pinion 50 includes a series of circumferentially-arranged teeth 52 engaging both the upper teeth 34 of the second strap 28 and the lower teeth 32 of the first strap 26. As a result of this arrangement, rotation of the pinion 50 results in movement of the first and second strap 28 relative to the base member 40. More specifically, when viewed from the front of the helmet 10 (FIG. 6), counter-clockwise rotation of the pinion 50 results in tightening of the straps 26,28 (i.e., moving the straps 26,28 toward each other and adjusting the helmet 10 to a smaller size), and clockwise rotation results in loosening of the straps 26,28 (i.e., moving the straps 26,28 away from each other and adjusting the helmet 10 to a larger size).

The adjustment mechanism 38 further includes a clutch mechanism that retains the pinion 50 in the desired position until an adjustment is desired. Referring to FIGS. 3 and 4, the clutch mechanism includes a clutch base 60 secured to the pinion 50, drive tabs 62 extending from the clutch base 60, locking members in the form of flexible arms 64 extending from the clutch base 60, and a disk portion 66 between the clutch base 60 and the pinion 50. The clutch base 60, drive tabs 62, flexible arms 64, disk portion 66, and pinion 50 are all integrally formed as a single part called the clutch member 65. The clutch member 65 includes a cylindrical bore 67 adapted to rotationally receive the base post 44. As a result of the integral nature of the illustrated clutch member 65, rotation of the drive tabs 62 about the base post 44 will result in rotation of the pinion 50 about the base post 44, as described below in more detail.

Each flexible arm 64 extends from the clutch base 60 in a cantilever-like fashion such that a free end of each flexible arm 64 is able to resiliently flex and move relative to the clutch base 60. The end of each flexible arm 64 includes a latch tooth (i.e., a first latch tooth 68 and a second latch tooth 70) and a first cam portion including a ramped surface 72, the function of which will be described below in more detail. Due to its inherent flexible and resilient characteristics, when flexed radially-inwardly, each flexible arm 64 provides a radially-outward bias to the corresponding latch tooth 68,70.

Referring to FIG. 2, the adjustment mechanism 38 further includes a cover member 82 that is adapted to be secured to the base member 40 at the bridge portions 42 by any suitable mechanism, such as a mechanical fastener or adhesive. The cover member 82 includes a cover post 84 extending toward and in alignment with the base post 44 of the base member 40. When the cover member 82 is secured to the base member 40, the cover post 84 is positioned inside the bore 67 to rotationally support the clutch member 65 and essentially acts as an extension of the base post 44.

The cover member 82 includes a cylindrically-shaped recess 86 defined by a series of radially-inwardly facing cover teeth 88. When the adjustment mechanism 38 is assembled, the latch tooth 68,70 of each flexible arm 64 engages the cover teeth 88 in such a manner as to prevent rotation of the clutch member 65 relative to the base member 40 and cover member 82. More specifically, when viewed from the front of the helmet (FIG. 6) the first latch tooth 68 substantially prevents counter-clockwise rotation of the clutch member 65 due to its engagement with the cover teeth 88, and the second latch tooth 70 substantially prevents clockwise rotation of the clutch member 65 due to its engagement with the cover teeth 88. Due to the shape of the first latch tooth 68 and its ability to move radially inwardly by flexing the corresponding flexible arm 64, the first latch tooth 68 does not prevent rotation of the clutch member 65 in the clockwise direction. Rather, when the clutch member 65 is rotated in the clockwise direction, the first latch tooth 68 will cam off of the cover teeth 88 to act as a ratcheting detent. Similarly, the second latch tooth 70 acts as a ratcheting detent when the clutch member 65 is rotated in the counter-clockwise direction.

Figure 5:
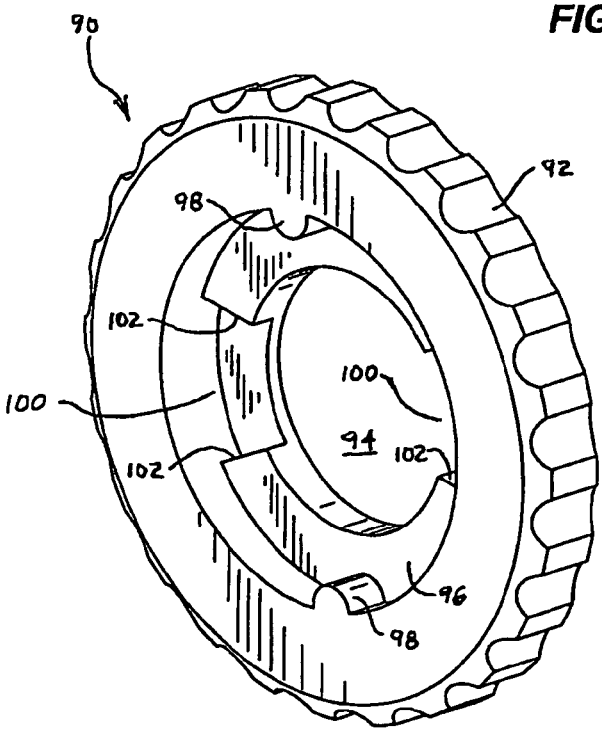
FIG. 5 is a rear perspective view of a dial.

The adjustment mechanism 38 further includes a release mechanism that facilitates rotation of the clutch member 65 and pinion 50. Referring to FIGS. 2 and 5, the release mechanism includes an input member in the form of a dial 90 that is sandwiched between the base member 40 and the cover member 82. The dial 90 is disk-shaped and includes a coined outer edge 92 to facilitate gripping by a user's fingers in order to rotate the dial 90. The dial 90 further includes a central, disk-shaped hole 94 dimensioned to receive the disk portion 66 of the clutch base 60 such that the dial 90 can rotate relative to the disk portion 66. The dial 90 further includes a cylindrical recess 96 dimensioned to receive the flexible arms 64 of the clutch member 65.

The dial 90 further includes second cam portions in the form of semi-cylindrical bumps 98 extending radially inward from the surface defining the cylindrical recess 96. As shown in FIG. 6, the bumps 98 are positioned adjacent to and are circumferentially aligned with the ramped surfaces 72 of the flexible arms 64. As a result of this orientation, rotation of the dial 90 relative to the clutch member 65 will cause one of the bumps 98 to cam against a corresponding ramped surface 72 to thereby cause radially-inward deflection of the corresponding flexible arm 64. This deflection of the flexible arm 64 will result in the disengagement of the corresponding latch tooth 68,70 from the cover teeth 88, which will allow the clutch member 65 and pinion 50 to be rotated in the same direction that the dial 90.

The dial 90 further includes opposing wedge-shaped recesses 100 that are defined by drive surfaces 102 on either end. Each wedge-shaped recess 100 is dimensioned to loosely receive one of the drive tabs 62 of the clutch member 65. In the neutral position (FIG. 6), each drive tab 62 will be approximately centrally positioned within the corresponding wedge-shaped recess 100. As a result of this configuration, the dial 90 can be rotated slightly in each direction without the drive surfaces 102 engaging the corresponding drive tab 62. After a certain amount of rotation of the dial 90 (e.g. 35 degrees), the drive surfaces 102 will engage the corresponding tab 62.

In operation, the size of the helmet 10 can be adjusted by rotating the dial 90. When in the neutral or static position (i.e., with no user input to the dial 90), the bumps 98 on the dial 90 are adjacent to but not pressing against the ramped surfaces 72 (FIG. 6). As a result, the latch teeth 68,70 are in engagement with the cover teeth 88, and the clutch member 65 and pinion 50 are substantially prevented from rotating.

Figure 7:
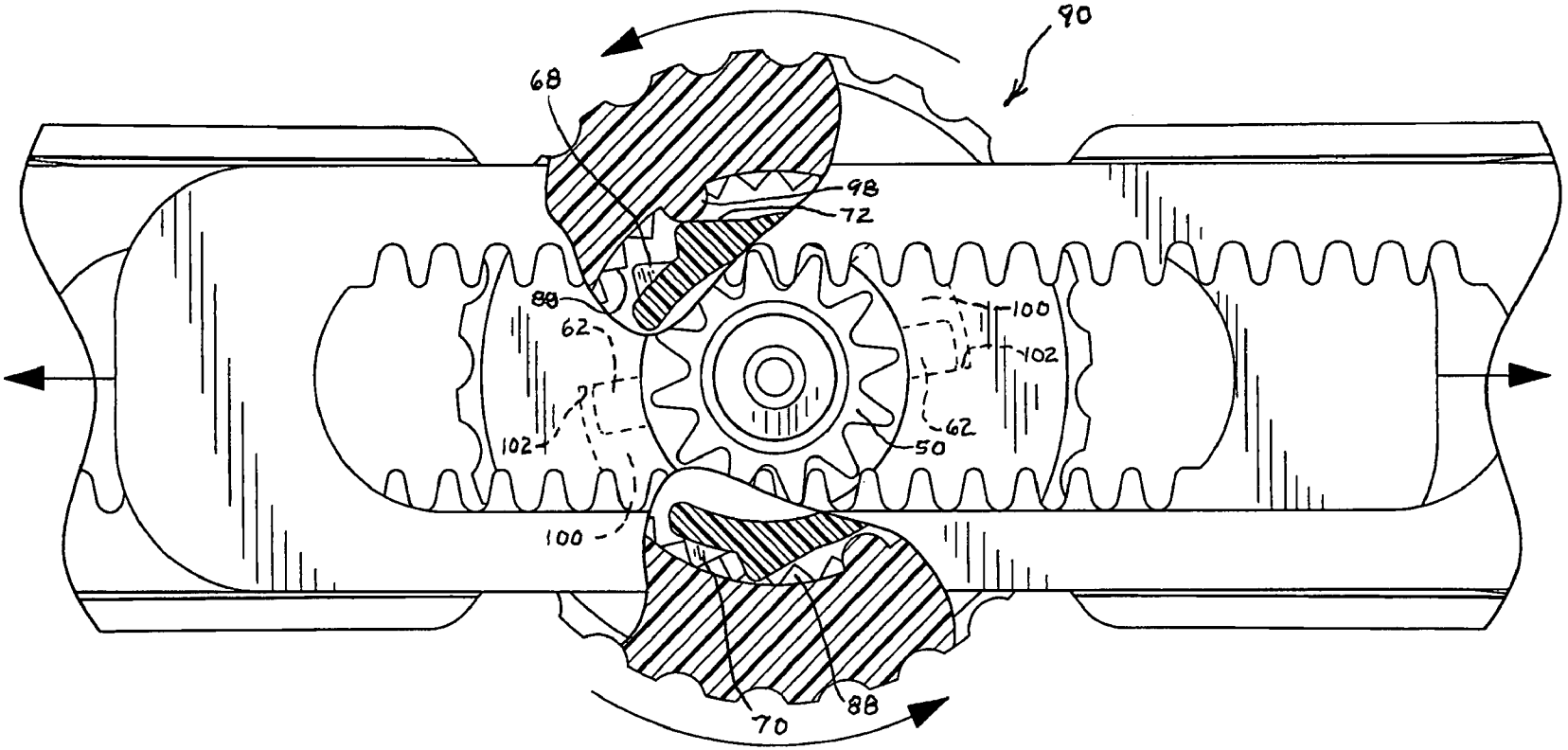
FIG. 7 is the front view of FIG. 6 with the adjustment mechanism in a tightening position.

When it is desired to tighten the helmet 10 (i.e., make the helmet 10 smaller), the dial 90 is rotated counter-clockwise (FIG. 7) by the user. Counter-clockwise rotation of the dial 90 causes one of the bumps 98 to engage the corresponding ramped surface 72, and causes disengagement of the first latch tooth 68 from the cover teeth 88. Further rotation of the dial 90 in the counter-clockwise direction results in the drive surfaces 102 of the dial 90 engaging the tabs 62 on the clutch member 65. Continued counter-clockwise rotation of the dial 90 results in counter-clockwise rotation of the clutch member 65 and pinion 50, which causes tightening of the straps 26,28. During this tightening rotation, the second latch tooth 70 ratchets off of the cover teeth 88 to act as a detent. When the desired size of the helmet 10 is achieved, the user releases the dial 90, and the dial 90 will return to the neutral position due to the biasing forced provided by the flexible arm 64 through its ramped surface 72 and on the bump 98. As the dial 90 returns to its neutral position, the first latch tooth 68 reengages with the cover teeth 88.

Figure 8:
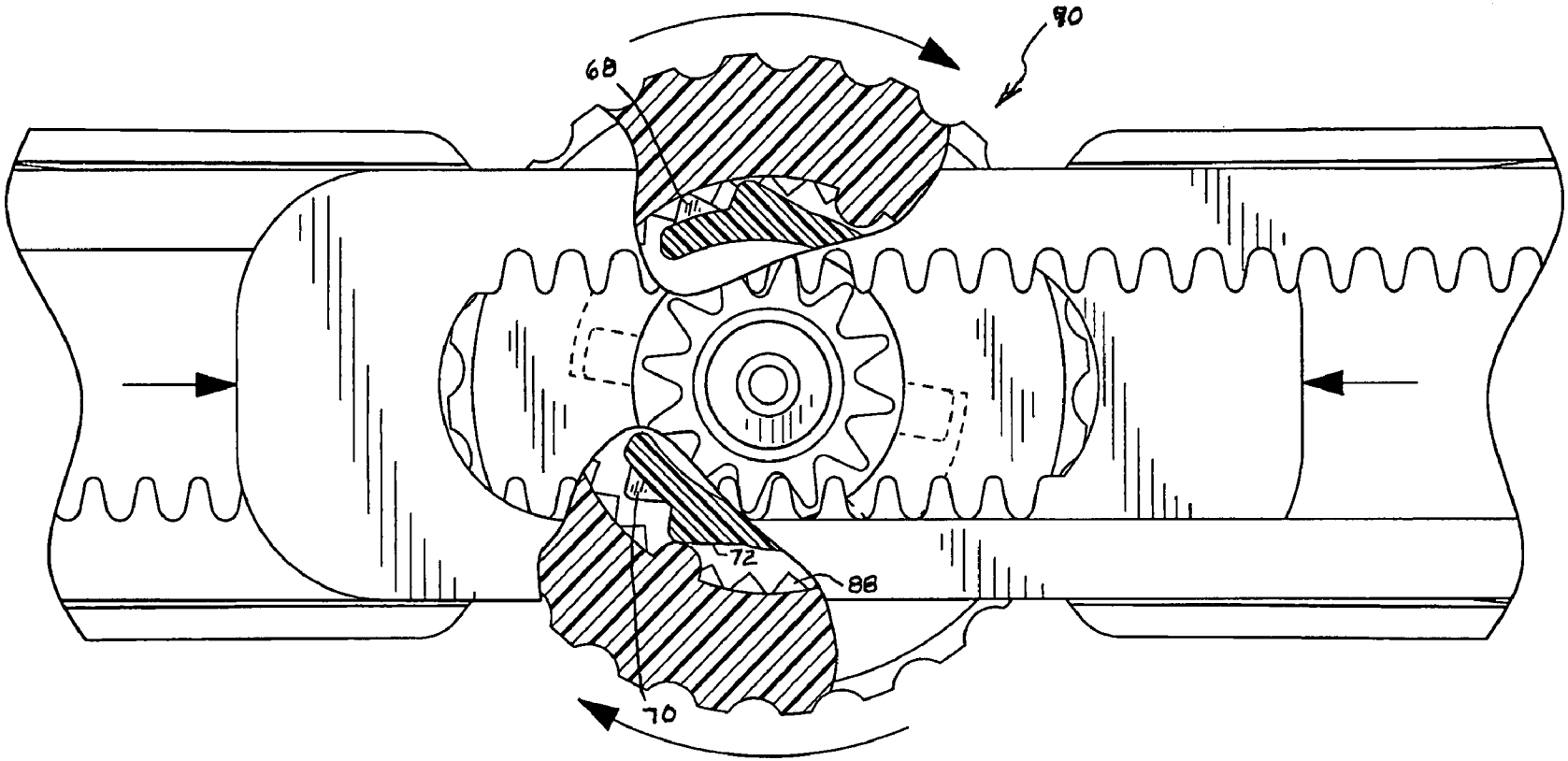
FIG. 8 is the front view of FIG. 6 with the adjustment mechanism in a loosening position.

Loosening of the helmet 10 (i.e., making the helmet 10 larger) is accomplished by rotating the dial 90 in the clockwise direction, as will be apparent to one skilled in the art. This operation is generally illustrated in FIG. 8.

The invention claimed is:

1. A helmet comprising:

a shell adapted to fit on a user's head;

first and second retention members coupled to the shell and movable with respect to each other to adjust a size of the helmet; and an adjustment mechanism coupled to the retention members, the adjustment mechanism comprising:

an actuating member coupled to at least one of the retention members and movable in two directions to move at least one of the retention members relative to the other;

a clutch mechanism coupled to the actuating member and including at least one locking member that inhibits movement of the actuating member in both of the two directions, wherein the at least one locking member is movable between a locked position, where the actuating member is substantially prevented from moving, and an unlocked position, where the actuating member is not substantially prevented from moving; and a release mechanism adapted to move the at least one locking member from the locked position to the unlocked position to allow movement of the actuating member, wherein the adjustment mechanism provides a ratcheting detent when moving the actuating member.

2. A helmet as claimed in claim 1, where the retention members comprise straps.

3. A helmet as claimed in claim 1, wherein at least one of the retention members comprise a series of adjustment teeth, and wherein the actuating member comprises a rotatable pinion engaging the adjustment teeth.

4. A helmet as claimed in claim 1, wherein the at least one locking member includes a first locking member that inhibits movement of the actuating member in a first direction and a second locking member that inhibits movement of the actuating member in a second direction, wherein each of the first and second locking members is movable between a locked position, where the actuating member is substantially prevented from moving in the respective direction, and an unlocked position, where the actuating member is not substantially prevented from moving in the respective direction, and wherein the release mechanism is adapted to move the first locking member from the locked position to the unlocked position while simultaneously leaving the second locking member in the locked position to thereby allow the actuating member to move in the first direction, and wherein the second locking member provides the ratcheting detent when the actuating member is being moved in the first direction.

5. A helmet as claimed in claim 1, wherein the clutch mechanism further comprises a series of clutch teeth for releasable engagement by the at least one locking member.

6. A helmet as claimed in claim 5, wherein the at least one locking member comprises a flexible arm having a latch portion for engaging the clutch teeth.

7. A helmet as claimed in claim 6, wherein the flexible arm further includes a first cam portion, and wherein the adjustment mechanism further includes an input member movable by a user and including a second cam portion adapted to engage the first cam portion to move the locking member from the locked position to the unlocked position.

8. A helmet as claimed in claim 7, wherein the input member is movable relative to the clutch member between a static position and an adjusting position, wherein the locking member is in the locked position when the input member is in the static position, wherein movement of the input member to the adjusting position automatically moves the locking member to the unlocked position.

9. A helmet as claimed in claim 8, and wherein the input member further includes a drive portion adapted to drive the actuating member when the input member is in the adjusting position.

10. A helmet comprising:

a shell adapted to fit on a user's head;

first and second retention members coupled to the shell and movable with respect to each other to adjust a size of the helmet; and an adjustment mechanism coupled to the retention members, the adjustment mechanism comprising:

an actuating member coupled to at least one of the retention members and movable in two directions to move at least one of the retention members relative to the other;

a clutch member coupled to the actuating member and including a first locking member that inhibits movement of the actuating member in a first direction and a second locking member that inhibits movement of the actuating member in a second direction, wherein each of the locking members is movable between a locked position, where the actuating member is substantially prevented from moving in the respective direction, and an unlocked position, where the actuating member is not substantially prevented from moving in the respective direction; and a release mechanism adapted to move the first locking member from the locked position to the unlocked position while simultaneously leaving the second locking member in the locked position.

11. A helmet as claimed in claim 10, where the retention members comprise straps.

12. A helmet as claimed in claim 10, wherein at least one of the retention members comprise a series of adjustment teeth, and wherein the actuating member comprises a rotatable pinion engaging the adjustment teeth.

13. A helmet as claimed in claim 10, and wherein the second locking member provides the ratcheting detent when the actuating member is being moved in the first direction.

14. A helmet as claimed in claim 10, wherein the clutch mechanism further comprises a series of clutch teeth for releasable engagement by the first and second locking members.

15. A helmet as claimed in claim 14, wherein the first and second locking members each comprise a flexible arm having a latch portion for engaging the clutch teeth.

16. A helmet comprising:

a shell adapted to fit on a user's head;

first and second retention members coupled to the shell and movable with respect to each other to adjust a size of the helmet; and an adjustment mechanism coupled to the retention members, the adjustment mechanism comprising:

an actuating member coupled to at least one of the retention members and movable in two directions to move at least one of the retention members relative to the other;

a clutch member coupled to the actuating member and including a locking member that inhibits movement of the actuating member in a direction, wherein the locking member is movable between a locked position, where the actuating member is substantially prevented from moving in the direction, and an unlocked position, where the actuating member is not substantially prevented from moving in the direction; and an input member movable relative to the clutch member between a static position and an adjusting position, wherein the locking member is in the locked position when the input member is in the static position, wherein movement of the input member to the adjusting position automatically moves the locking member to the unlocked position, and wherein the input member further includes a drive portion adapted to drive the actuating member when the input member is in the adjusting position.

17. A helmet as claimed in claim 16, wherein the clutch mechanism further comprises a series of clutch teeth, and wherein the locking member comprises a flexible arm having a latch portion for releasable engagement with the clutch teeth.

18. A helmet as claimed in claim 17, wherein the flexible arm further includes a first cam portion, and wherein the input member comprises a dial that is rotatable by a user and including a second cam portion adapted to engage the first cam portion to move the locking member from the locked position to the unlocked position.

19. A helmet as claimed in claim 18, and wherein the dial further includes a drive portion adapted to drive the actuating member when the input member is in the adjusting position.

* * * * *